US010694843B2

(12) United States Patent
Nuss

(10) Patent No.: US 10,694,843 B2
(45) Date of Patent: Jun. 30, 2020

(54) ADJUSTABLE SHELVING ASSEMBLY FOR A REFRIGERATOR APPLIANCE

(71) Applicant: Haier US Appliance Solutions, Inc., Wilmington, DE (US)

(72) Inventor: Bart Andrew Nuss, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 171 days.

(21) Appl. No.: 15/701,494

(22) Filed: Sep. 12, 2017

(65) Prior Publication Data

US 2019/0075924 A1 Mar. 14, 2019

(51) Int. Cl.

| | |
|---|---|
| ***A47B 96/04*** | (2006.01) |
| ***A47B 57/06*** | (2006.01) |
| ***F25D 25/02*** | (2006.01) |
| ***A47B 57/08*** | (2006.01) |
| *F25D 25/04* | (2006.01) |
| *A47B 96/02* | (2006.01) |

(52) U.S. Cl.

CPC ..... *A47B 57/06* (2013.01); *A47B 57/08* (2013.01); *F25D 25/02* (2013.01); *A47B 96/028* (2013.01); *F25D 25/04* (2013.01)

(58) Field of Classification Search

CPC ..... A47B 57/06; A47B 57/08; A47B 96/028; A47B 2200/0056; F25D 25/02; F25D 25/04

See application file for complete search history.

(56) References Cited

U.S. PATENT DOCUMENTS

| | | | | |
|---|---|---|---|---|
| 2,813,635 | A * | 11/1957 | Schumacher | F25D 25/027 108/138 |
| 3,707,930 | A * | 1/1973 | Yindra | A47B 9/04 108/147 |
| 3,982,801 | A * | 9/1976 | Heidorn | A47B 57/06 312/306 |
| 5,199,778 | A * | 4/1993 | Aoki | A47B 57/32 312/408 |
| 6,065,821 | A * | 5/2000 | Anderson | A47B 57/06 108/108 |
| 7,611,111 | B2 | 11/2009 | Costa et al. | |
| 8,746,819 | B2 * | 6/2014 | Donmez | F25D 25/02 312/408 |
| 9,518,776 | B2 * | 12/2016 | Baldo | F25D 25/02 |
| 10,334,948 | B2 * | 7/2019 | Xiang | A47F 5/103 |

* cited by examiner

*Primary Examiner* — Matthew W Ing
(74) *Attorney, Agent, or Firm* — Dority & Manning, P.A.

(57) ABSTRACT

An adjustable shelving assembly for a refrigerator appliance includes a braking rack fixed on a rear wall of a cabinet and a drive screw extending substantially parallel to the braking rack. A shelf is fixed to a clutch assembly that includes a half nut positioned around the drive screw and a brake pawl positioned adjacent the braking rack. An actuation mechanism is operably coupled to the half nut and the brake pawl for moving the clutch assembly between a first position where the half nut closes to engage the drive screw and the brake pawl is disengaged, and a second position where the half nut is open and the brake pawl engages the braking rack.

19 Claims, 9 Drawing Sheets

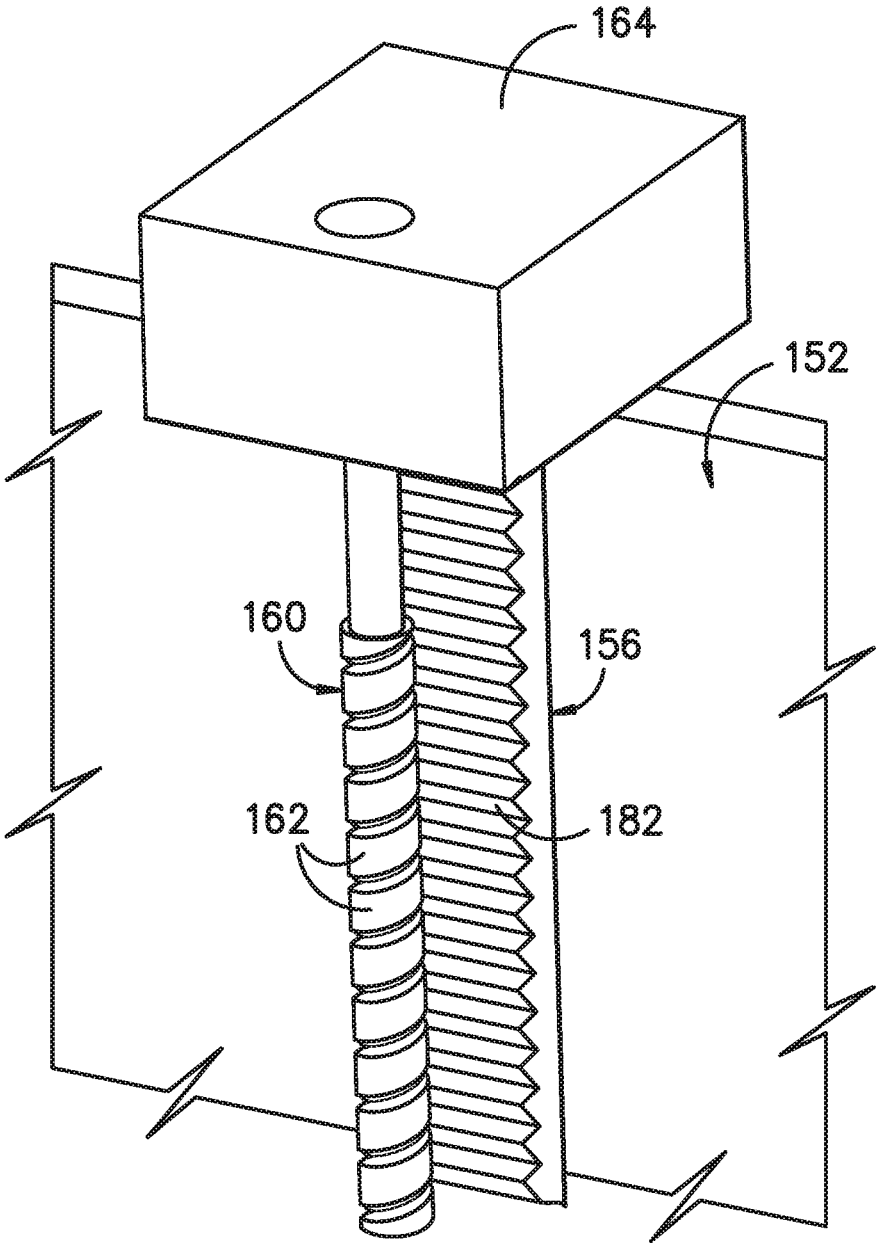
FIG. -4-
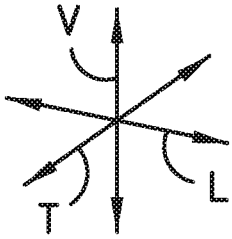

ADJUSTABLE SHELVING ASSEMBLY FOR A REFRIGERATOR APPLIANCE

FIELD OF THE INVENTION

The present disclosure is related generally to refrigerator appliances, and more particularly to refrigerator appliances that include adjustable shelves.

BACKGROUND OF THE INVENTION

Refrigerator appliances generally include a cabinet that defines a chilled chamber for receipt of food articles for storage. The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber. Certain conventional refrigerator appliances include adjustable shelves that can be moved from one shelf mounting position to another within the refrigerator appliance. In this manner, the configuration of shelves within the refrigerator can be arranged to suit the needs of a user.

For example, certain refrigerator appliances include slotted tracks mounted vertically on a rear wall of the appliance. Shelves may include mounting brackets that engage slots in the slotted tracks such that a user may remove and reposition the shelf. However, movement of such shelves is very labor intensive and time consuming. In this regard, a user must remove all items on the shelf, pop the shelf out of the slotted track, and reposition the shelf before returning the removed items. In addition, there is a likelihood of improper alignment of the shelf which can cause items to slide off the shelf and/or result in the shelf falling off of the slotted track.

Accordingly, a refrigerator appliance with features for improving the adjustability of shelves within the chilled chamber would be useful. More particularly, a refrigerator appliance with features for automatically and easily adjusting one or more of a plurality of shelves simultaneously would be particularly beneficial.

BRIEF DESCRIPTION OF THE INVENTION

The present invention provides an adjustable shelving assembly for a refrigerator appliance that includes a braking rack fixed on a rear wall of a cabinet and a drive screw extending substantially parallel to the braking rack. A shelf is fixed to a clutch assembly that includes a half nut positioned around the drive screw and a brake pawl positioned adjacent the braking rack. An actuation mechanism is operably coupled to the half nut and the brake pawl for moving the clutch assembly between a first position where the half nut closes to engage the drive screw and the brake pawl is disengaged, and a second position where the half nut is open and the brake pawl engages the braking rack. Additional aspects and advantages of the invention will be set forth in part in the following description, or may be apparent from the description, or may be learned through practice of the invention.

In one exemplary embodiment, an adjustable shelving system including a braking rack fixed on a wall, a drive screw extending substantially parallel to the braking rack, a drive motor operably coupled to the drive screw, and a shelf. A clutch assembly is fixed to the shelf and includes a half nut positioned around the drive screw and a brake pawl positioned adjacent the braking rack. The clutch assembly is movable between a first position where the half nut closes to engage the drive screw and the brake pawl is disengaged, and a second position where the half nut is open and the brake pawl engages the braking rack.

In another exemplary embodiment, a refrigerator appliance defining a vertical direction, a lateral direction, and a transverse direction is provided. The refrigerator appliance includes a cabinet including a rear wall and defining a fresh food chamber and a door being rotatably hinged to the cabinet to provide selective access to the fresh food chamber. An adjustable shelving system is positioned within the fresh food chamber and includes a braking rack fixed on the rear wall, a drive screw extending substantially parallel to the braking rack, a drive motor operably coupled to the drive screw, and a shelf. A clutch assembly is fixed to the shelf and includes a half nut positioned around the drive screw and a brake pawl positioned adjacent the braking rack. The clutch assembly is movable between a first position where the half nut closes to engage the drive screw and the brake pawl is disengaged, and a second position where the half nut is open and the brake pawl engages the braking rack.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 4 provides a perspective view of a braking rack and a drive screw of the exemplary adjustable shelving assembly of FIG. 3.

Figure 1:
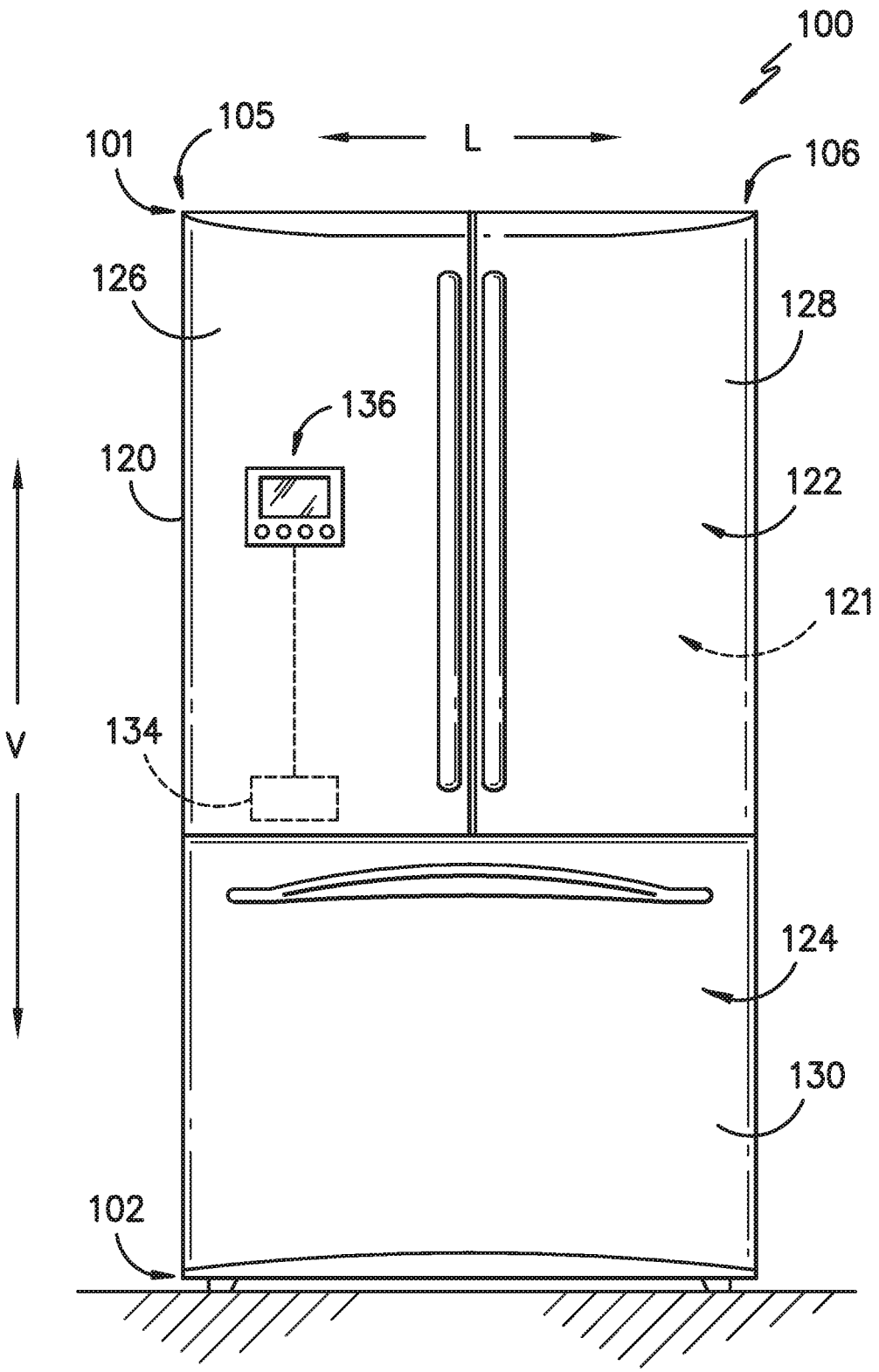
FIG. 1 provides a front view of a refrigerator appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a refrigerator appliance 100 according to an exemplary embodiment of the present subject matter. Refrigerator appliance 100 extends between a top 101 and a bottom 102 along a vertical direction V. Refrigerator appliance 100 also extends between a first side 105 and a second side 106 along a lateral direction L. A transverse direction T (FIG. 2) is defined perpendicular to the vertical and lateral directions V, L. Accordingly, vertical direction V, lateral direction L, and transverse direction T are mutually perpendicular and form an orthogonal direction system.

Refrigerator appliance 100 includes a housing or cabinet 120 defining a volume 121. Cabinet 120 also defines an upper fresh food chamber 122 and a lower freezer chamber 124 arranged below the fresh food chamber 122 on the vertical direction V. As such, refrigerator appliance 100 is generally referred to as a bottom mount refrigerator. In this exemplary embodiment, cabinet 120 also defines a mechanical compartment (not shown) for receipt of a sealed cooling system (not shown). It will be appreciated that the present subject matter can be used with other types of refrigerators (e.g., side-by-sides), freezer appliances, other types of appliances, and/or any other suitable shelving system. Consequently, the description set forth herein is for exemplary purposes only and is not intended to limit the scope of the present subject matter in any aspect.

Refrigerator appliance 100 includes refrigerator doors 126, 128 that are rotatably hinged to an edge of cabinet 120 for accessing fresh food chamber 122. It should be noted that while doors 126, 128 are depicted in a "french door" configuration, any suitable arrangement or number of doors is within the scope and spirit of the present subject matter. A freezer door 130 is arranged below refrigerator doors 126, 128 for accessing freezer chamber 124.

Operation of refrigerator appliance 100 can be regulated by a controller 134 that is operatively coupled to a user interface panel 136. Panel 136 provides selections for user manipulation of the operation of refrigerator appliance 100 such as e.g., interior shelf lighting settings. In response to user manipulation of user interface panel 136, controller 134 operates various components of refrigerator appliance 100. Controller 134 may include a memory and one or more processors, microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

Controller 134 may be positioned in a variety of locations throughout refrigerator appliance 100. In the illustrated embodiment, controller 134 is located within door 126. In such an embodiment, input/output ("I/O") signals may be routed between the controller and various operational components of refrigerator appliance 100. In one embodiment, user interface panel 136 may represent a general purpose I/O ("GPIO") device or functional block. The user interface 136 may include input components, such as one or more of a variety of electrical, mechanical or electro-mechanical input devices including rotary dials, push buttons, and touch pads. User interface 136 may include a display component, such as a digital or analog display device designed to provide operational feedback to a user. The user interface 136 may be in communication with controller 134 via one or more signal lines or shared communication busses.

Figure 2:
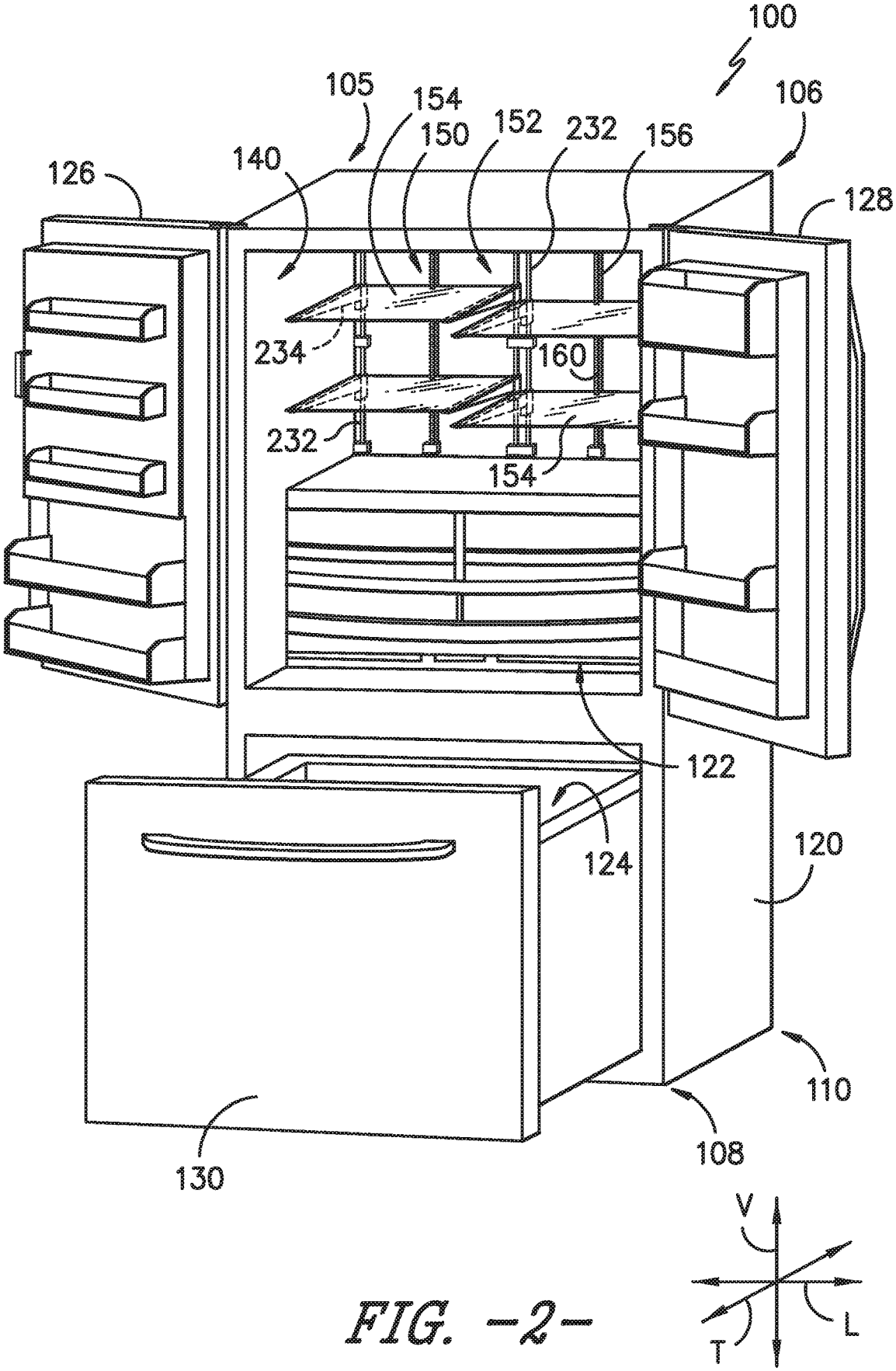
FIG. 2 provides a front perspective view of the exemplary refrigerator appliance of FIG. 1 with refrigerator doors and a freezer door shown in an open configuration to reveal a fresh food chamber and freezer chamber of the refrigerator appliance according to an exemplary embodiment of the present subject matter.

FIG. 2 provides a front, perspective view of refrigerator appliance 100 having refrigerator doors 126, 128 in an open position to reveal the interior of fresh food chamber 122. Additionally, freezer door 130 is shown in an open position to reveal the interior of freezer chamber 124. As shown more clearly in FIG. 2, refrigerator appliance 100 extends in the transverse direction T between a front end 108 and a rear end 110.

As shown in FIG. 2, for this exemplary embodiment, fresh food chamber 122 of refrigerator appliance 100 includes an adjustable shelving system 150 mounted to a rear wall 152 of cabinet 120. More specifically, adjustable shelving system 150 includes two columns of shelves 154 spaced apart generally along the vertical direction V. Although FIGS. 3 through 9 describe the structure and function of one adjustable shelving system 150 or a single column of shelves 154, it should be appreciated that refrigerator appliance 100 may include any suitable number of shelves 154 in any suitable position or configuration. For example, in alternative embodiments, adjustable shelving system 150 could include shelves 154 mounted to another surface within the interior of cabinet 120, such as to one of the sidewalls 140 of cabinet 120 or in the freezer chamber 124. In addition, in some embodiments, shelves 154 could alternatively be vertically extending dividers that translate along the lateral direction L or any other suitable movable platform.

According to the illustrated embodiment, adjustable shelving system 150 is positioned within fresh food chamber 122. Adjustable shelving system 150 is generally configured for moving shelves 154 of refrigerator appliance 100 along the vertical direction V. In this manner, shelves 154 may be selectively positioned by a user in different shelf mounting positions within fresh food chamber 122. For instance, one adjustable shelf 154 could be moved vertically upward or downward along the vertical direction V. In this manner, if one shelf 154 requires ample storage room for a particularly tall pot, shelves 154 can be raised or lowered to accommodate the pot. Moreover, as described below, adjustable shelving system 150 may selectively move one or more of the shelves 154 independently from adjacent shelves 154.

In general, adjustable shelving system 150 includes a braking rack 156 fixed on a wall of refrigerator appliance 100. According to the illustrated embodiment, braking rack 156 is positioned on rear wall 152 of refrigerator appliance 100 and extends substantially along the vertical direction V. However, it should be appreciated that in alternative embodiments, braking rack 156 may be positioned at any suitable location within refrigerator appliance 100.

Figure 5:
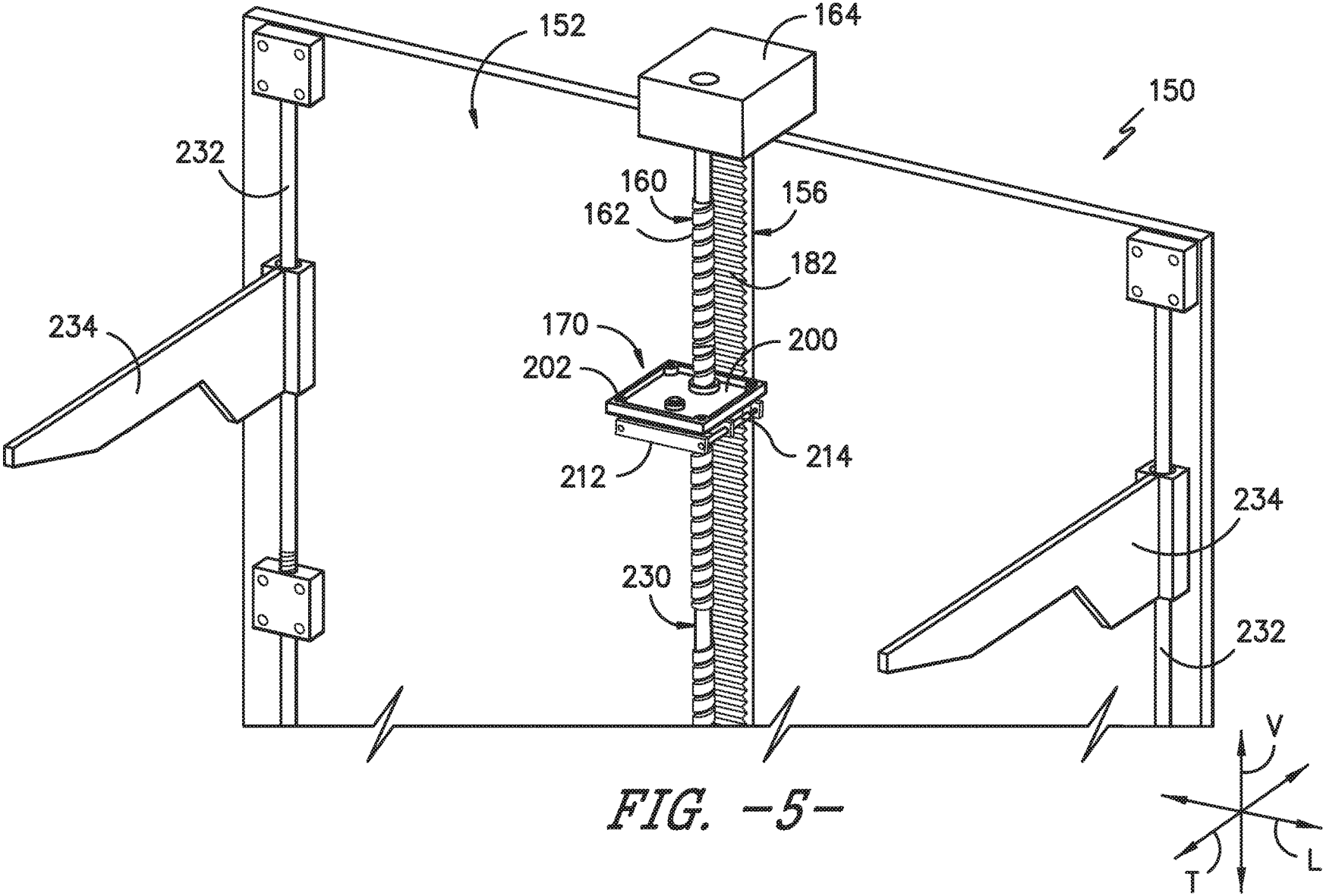
FIG. 5 provides a perspective view of the exemplary adjustable shelving assembly of FIG. 3 with shelves removed for clarity.

Referring now to FIGS. 4 and 5, adjustable shelving system 150 also includes a drive screw 160 that extends substantially parallel to the braking rack 156 (i.e., along the vertical direction V) and defines screw threads 162. In addition, a drive motor 164 is operably coupled to drive screw 160 for selectively rotating drive screw 160. Drive motor 164 may be, for example, an electric motor positioned at a top end of drive screw 160 along the vertical direction V. Although drive motor 164 is illustrated herein as a brushless DC motor, it should be appreciated that any suitable motor may be used while remaining within the scope of the present subject matter. For example, according to alternative embodiments, drive motor 164 may instead be a stepper motor, a synchronous permanent magnet motor, an AC motor, or any other suitable type of motor in any suitable configuration.

According to the illustrated embodiment, adjustable shelving system 150 may further include one or more clutch assemblies 170. More specifically, according to one exemplary embodiment, each shelf 154 may be mounted within refrigerator appliance 100 using a separate, dedicated clutch assembly 170. In this regard, and as described in detail below, each shelf 154 may be fixed to a clutch assembly 170 that is generally configured for selectively engaging drive screw 160 to permit vertical motion of shelf 154. In addition, clutch assembly 170 is configured selectively disengaging drive screw 160 and engaging braking rack 156 for fixing shelf 154 along the vertical direction V.

Figure 6:
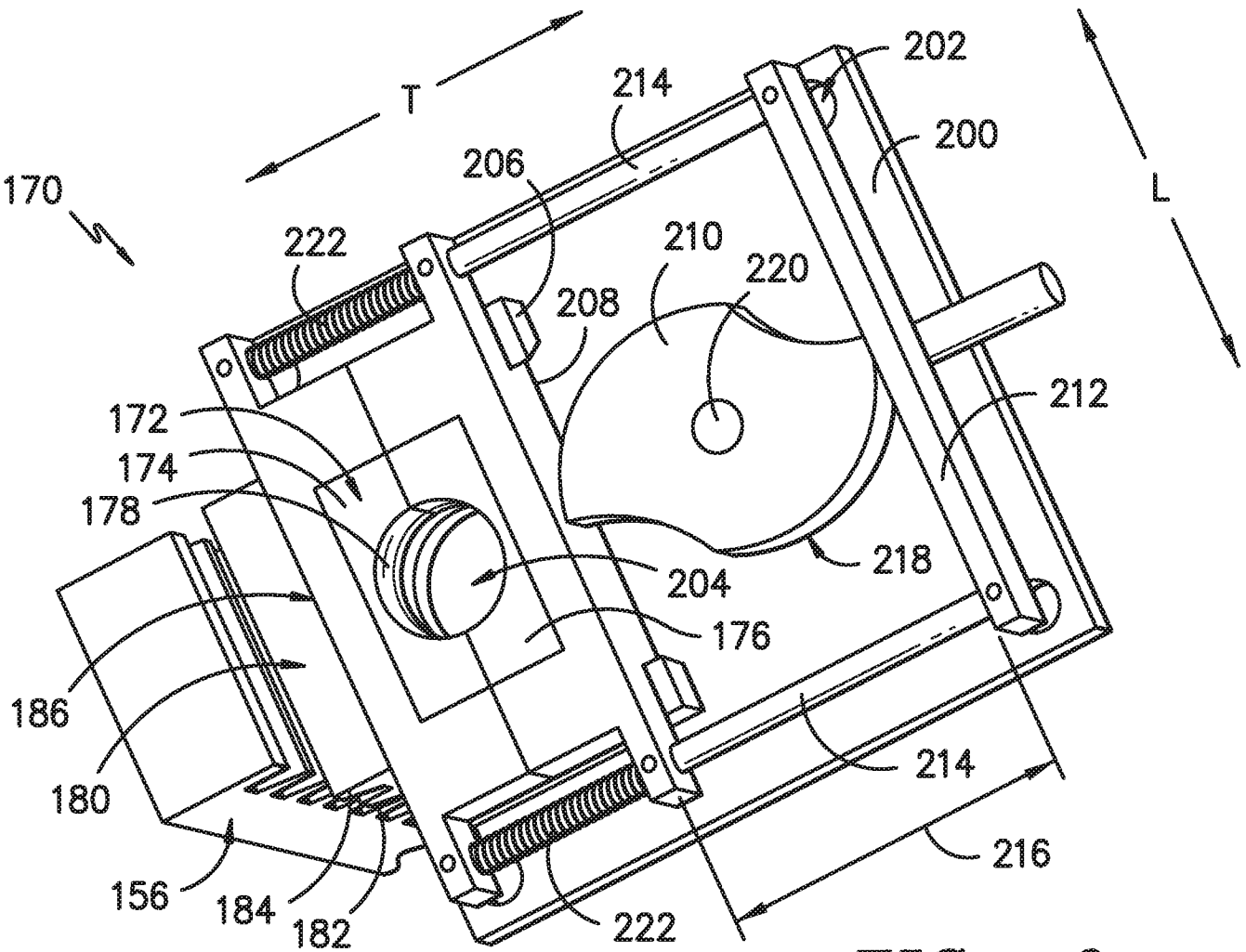
FIG. 6 provides a bottom, perspective view of a clutch assembly of the exemplary adjustable shelving assembly of FIG. 3 in a first position according to an exemplary embodiment of the present subject matter.
Figure 8:
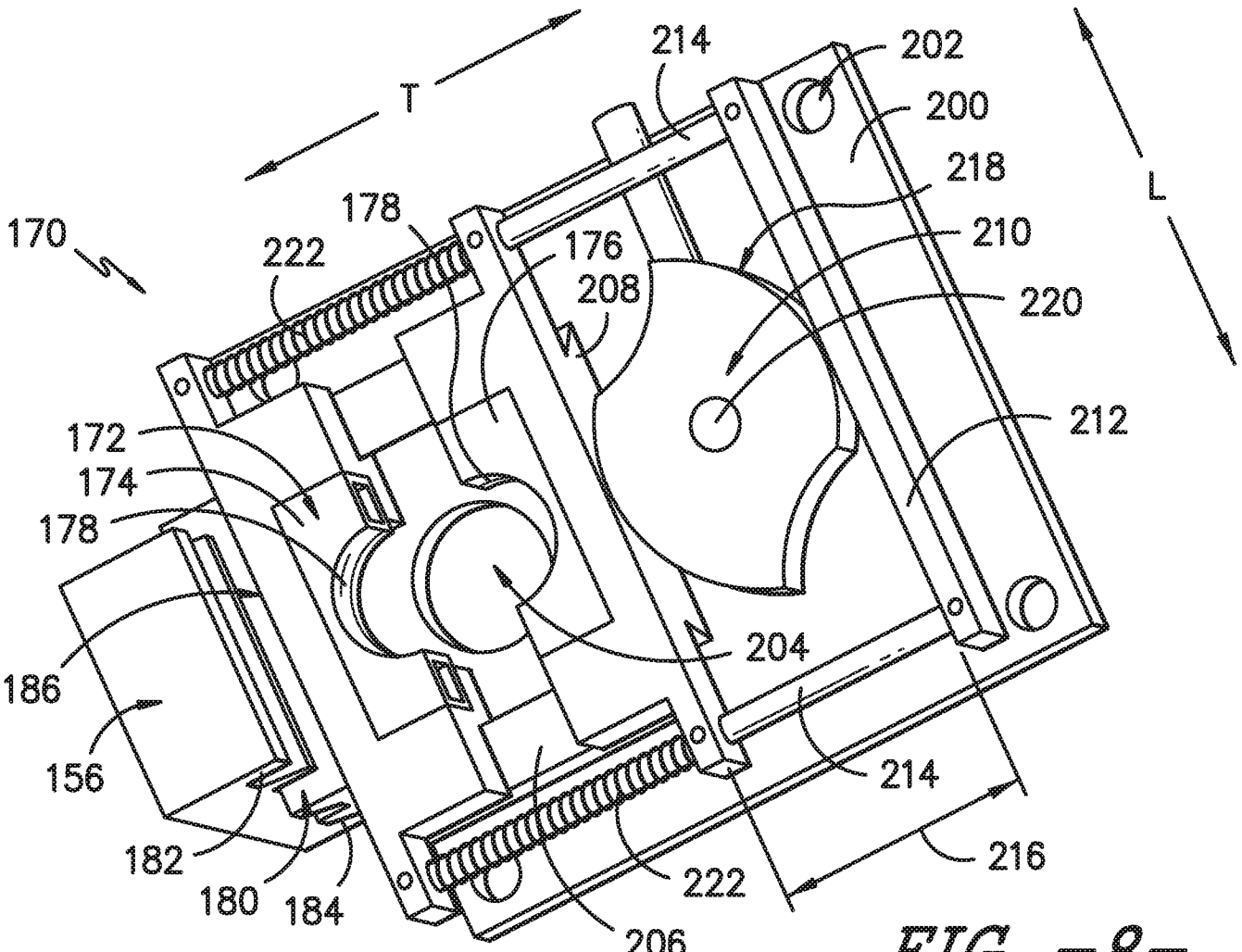
FIG. 8 provides a bottom, perspective view of the exemplary clutch assembly of FIG. 6 in a second position according to an exemplary embodiment of the present subject matter.

According to the illustrated embodiment, clutch assembly 170 includes a half nut 172 that is positioned around drive screw 160 and is configured for selectively engaging drive screw 160. More specifically, as best illustrated in FIGS. 6 and 8, half nut 172 is a screw nut that is split lengthwise into a first half 174 and a second half 176. Each of first half 174 and second half 176 define internal nut threads 178 on their internal circumference. In this manner, when first half 174 and second half 176 are positioned adjacent to each other, they form a complete screw nut with continuous threads that can engage screw threads 162 of drive screw 160. Although half nut 172 is illustrated herein as a screw nut split in half, it should be appreciated that half nut 172 may be any other suitable mechanism for engaging and disengaging drive screw 160. First half 174 and second half 176 are mounted within clutch assembly 170 such that they are movable relative to each other, as described in more detail below.

Figure 7:
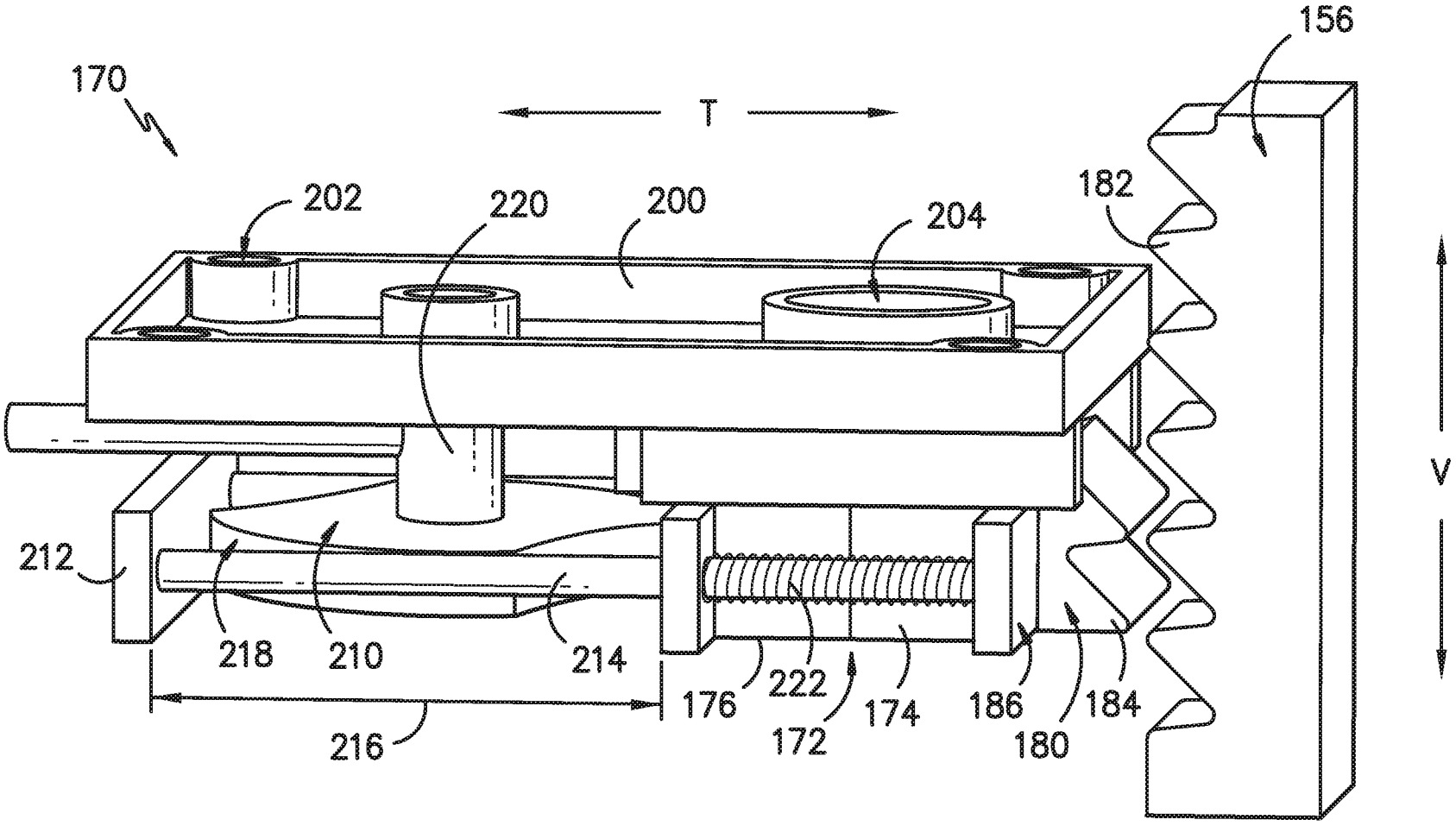
FIG. 7 provides another perspective view of the exemplary clutch assembly of FIG. 6 in the first position.
Figure 9:
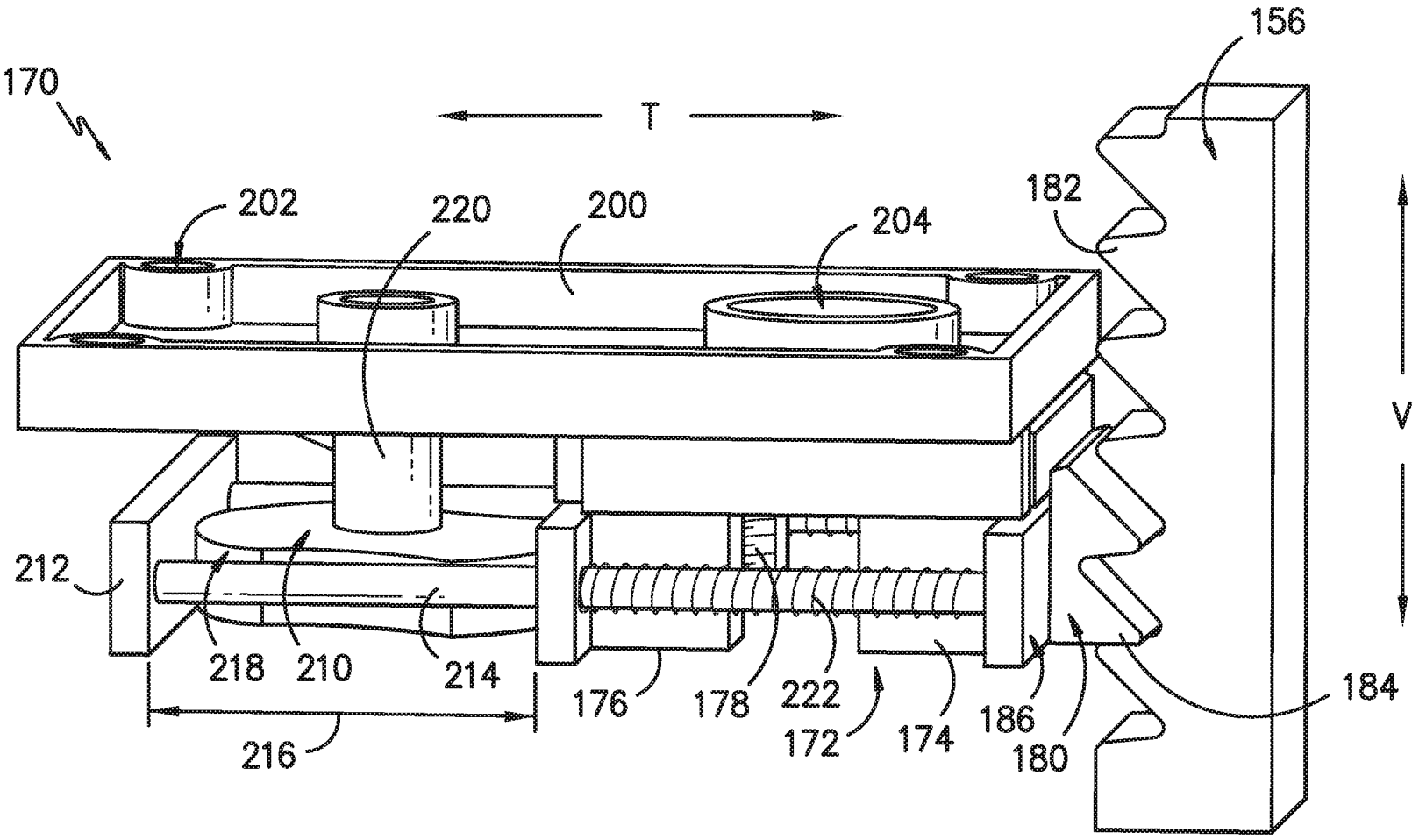
FIG. 9 provides another perspective view of the exemplary clutch assembly of FIG. 6 in the second position.

In addition, clutch assembly 170 includes a brake pawl 180 that is positioned adjacent braking rack 156 and is configured for selectively engaging braking rack 156. For example, referring specifically the FIGS. 6 through 9, according to one exemplary embodiment, braking rack 156 is a geared rack defining a plurality of rack teeth 182 and brake pawl 180 defines a plurality of pawl teeth 184. As illustrated, pawl teeth 184 define a negative geometry of rack teeth 182. Thus, when brake pawl 180 is in an extended position (as shown in FIGS. 8 and 9), pawl teeth 184 engage rack teeth 182 to lock clutch assembly 170 and prevent further motion along the vertical direction V. By contrast, when brake pawl 180 is in a retracted position (as shown in FIGS. 6 and 7), brake pawl 180 is moved along the transverse direction T such that pawl teeth 184 are not engaging rack teeth 182 and shelf 154 and clutch assembly 170 are movable along the vertical direction V.

According to the illustrated embodiment, pawl teeth 184 are defined on a back side 186 of first half 174 of half nut 172. In this manner, when first half 174 of half nut 172 moves away from second half 176 of half nut 172, pawl teeth 184 of brake pawl 180 are moved into engagement with rack teeth 182 of braking rack 156. Notably, such a structure ensures that half nut 172 and brake pawl 180 cannot simultaneously engage drive screw 160 and braking rack 156, respectively.

In operation, clutch assembly 170 is movable between a first position (FIGS. 6 and 7) and a second position (FIGS. 8 and 9) for allowing and preventing movement, respectively, along the vertical direction V. More specifically, when clutch assembly 170 is in the first position, half nut 172 closes to engage drive screw 160 such that rotational motion of drive screw 160 moves shelf 154 along the vertical direction V. By contrast, when clutch assembly 170 is in the second position, first half 174 and second half 176 of half nut 172 are separated and brake pawl 180 engages braking rack 156 to prevent movement along the vertical direction V.

Referring now to FIGS. 6 through 9, clutch assembly 170 will be described in more detail, particularly with respect to the means for moving between the first position and the second position. As illustrated, clutch assembly 170 includes a top plate 200 that is mounted to shelf 154. More specifically, shelf 154 may be mounted to top plate 200 by passing one or more mechanical fasteners, such as screws, bolts, rivets, etc. through one or more apertures 202. Alternatively, glue, welding, snap-fit mechanisms, interference-fit mechanisms, or any suitable combination thereof may secure top plate 200 to shelf 154.

Top plate 200 may further define a hole 204 through which drive screw 160 may pass and a flared mounting feature 206 that extends from top plate 200 and is configured for engaging first half 174 and second half 176 of half nut 172. More specifically, as best shown in FIGS. 6 and 8, flared mounting feature 206 may be received within a complementary mounting recess 208 defined in first half 174 and second half 176. In this manner, first half 174 and second half 176 may slide along the transverse direction T between the first position in the second position. In addition, flared mounting feature 206 and complementary mounting recess 208 ensure shelf 154 remains slidably coupled with clutch assembly 170.

Still referring to FIGS. 6 through 9, adjustable shelving system 150 may further include an actuation mechanism 210 that is operably coupled to half nut 172 and brake pawl 180. In this regard, actuation mechanism 210 is generally configured for moving clutch assembly 170 between the first position and the second position. More specifically, clutch assembly 170 may include a back plate 212 that is coupled to first half 174 of half nut 172 by an elongated rod 214. More specifically, clutch assembly 170 includes two elongated rods 214 that extend parallel to each other along the transverse direction T. Back plate 212 and first half 174 extend along the lateral direction L between elongated rods 214 and are separated by a fixed distance along the transverse direction T, e.g., the length of elongated rods 214. In addition, second half 176 of half nut 172 is slidably mounted to elongated rods 214 and is positioned between first half 174 of half nut 172 and back plate 212.

According to the illustrated embodiment, actuation mechanism 210 is positioned between back plate 212 and second half 176 of half nut 172 for controlling a separation distance 216 defined along the transverse direction T between back plate 212 and second half 176 of half nut 172. By controlling separation distance 216, actuation mechanism 210 may move first half 174 and second half 176 of half nut 172 between a first position where the nut threads 178 form a single screw nut and a second position where first half 174 and second half 176 are separated and brake pawl 180 engages braking rack 156 (as described above).

As best shown in FIGS. 6 and 8, actuation mechanism 210 is a manually controlled cam actuator. Cam actuator is defines cam surfaces 218 and is rotatable about a center pin 220 to adjust separation distance 216 and move brake pawl 180 and half nut 172 in the manner described herein. Although actuation mechanism 210 is illustrated as a cam actuator, it should be appreciated that according to alternative embodiments, actuation mechanism 210 may instead be a solenoid or any other suitable means for actuating clutch assembly 170.

Notably, it may be desirable to bias clutch assembly 170 into the second position where half nut 172 is disengaged and brake pawl 180 engages braking rack 156 to prevent movement along the vertical direction V. According to the illustrated embodiment, this is achieved by using a compression spring 222 that is positioned between first half 174 and second half 176 of half nut 172 to urge first half 174 and second half 176 away from each other. More particularly, for example, clutch assembly 170 includes compression springs 222 positioned around each elongated rod 214 between first half 174 and second half 176. In this manner, when actuation mechanism 210 (e.g., cam actuator) moves to the second position, compression springs 222 urge first half 174 and second half 176 apart to decrease separation distance 216. It should be appreciated that according to alternative embodiments, compression springs 222 are not required. For example, if actuation mechanism 210 is a solenoid, it may be configured to decrease separation distance 216 without the need for compression springs 222, e.g., because solenoid may be directly coupled to second half 176 and back plate 212 to impart the retraction force directly.

As described herein, clutch assembly 170 is a manually actuated clutch assembly 170 that is moved between the first position and the second position by actuation mechanism 210. However, it should be appreciated that according to alternative embodiments, adjustable shelving system 150 may be entirely automated. In this regard, for example, a user may press one or more buttons positioned on user input panel 136 or elsewhere on cabinet 102 to select a shelf 154 and to move that shelf 154 in the desired direction. More specifically, for example, user could select a shelf 154 and push an "up" button or a "down" button to move that shelf 154 along the vertical direction V. Upon receiving such a signal, controller 134 could be configured for actuating an actuation mechanism 210, e.g., a solenoid valve, for engaging clutch assembly 170 with drive screw 160. Simultaneously, controller 134 could initiate drive motor 164 to rotate drive screw 160 and move the respective shelf 154. When the user releases the button on user input panel 136, drive motor 164 may be turned off and actuation mechanism 210 may move to a second position for locking the vertical position of shelf 154.

In addition, adjustable shelving system 150 may include features for ensuring that shelves 154 do not collide with each other during operation. For example drive screw 160 may define one or more unthreaded regions 230. Unthreaded regions 230 are positioned between adjacent shelves 154 such that if a user inadvertently leaves clutch assembly 170 engaged when drive motor 164 is rotating drive screw 160, the associated shelf 154 will not enter into an area occupied by another shelf 154. In other words, the vertical motion of the shelf 154 ceases when half nut 172 of clutch assembly 170 reaches unthreaded regions 230 of drive screw 160.

Figure 3:
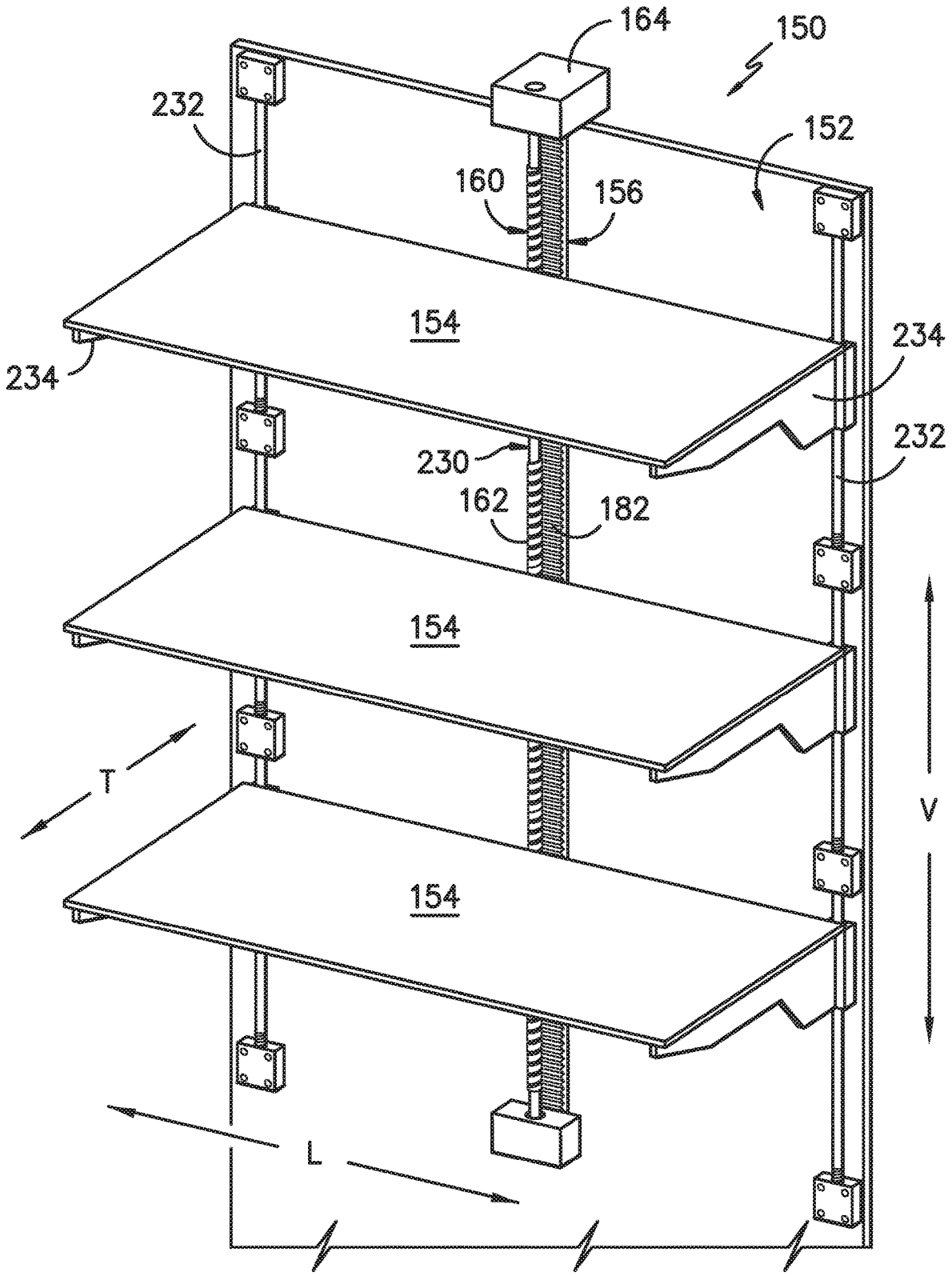
FIG. 3 provides a perspective view of an adjustable shelving assembly of the exemplary refrigerator appliance of FIG. 1 according to an exemplary embodiment of the present subject matter.

As shown in FIG. 3, braking rack 156 extends along the vertical direction V and is positioned proximate a center of each shelf 154 along the lateral direction L. In order to ensure that load imbalances on shelf 154 do not place too much torque on drive screw 160 or otherwise result in binding or operability issues, adjustable shelving system 150 may further include one or more lateral guide rods 232 that extend vertically and in parallel to drive screw 160 and braking rack 156. Similarly, lateral shelf supports 234 may be slidably mounted on lateral guide rods 232 and may be configured for providing vertical support to shelves 154. In this manner, lateral shelf supports 234 and lateral guide rods 232 ensure that shelves 154 remain in a horizontal orientation and reduce the likelihood of binding within adjustable shelving system 150.

As shown in FIG. 2, refrigerator appliance 100 includes four shelves 154 mounted on two adjustable shelving systems 150 that extend parallel to each other along the vertical direction V. According to one exemplary embodiment, each adjustable shelving system 150 has a dedicated drive motor 164 and drive screw 160 for moving shelves 154 along the vertical direction V. However, it should be appreciated that according to alternative embodiments, a single drive motor 164 may be used to drive both adjustable shelving systems 150. More specifically, for example, a single drive motor 164 may be coupled to a belt drive system (not shown), the belt drive system being coupled to the drive screws 160 associated with each of the adjustable shelving systems 150. In this manner, by rotating the single drive motor 164, both drive screws 160 may be rotated to impart vertical motion on the shelves 154 that have their clutch assembly 170 in the engaged position on drive screw 160.

Notably, clutch assembly 170 also enables versatility in the movement of one or more shelves 154. More specifically, for example, a user may move one or more clutch assemblies 170 associated with one or more shelves 154 into the engaged position and rotate drive screw 160 to selectively move those specific shelves 154 along the vertical direction V. By contrast, those clutch assemblies 170 which are not engaged as drive motor 164 rotates remain in the fixed position.

It should be appreciated that the embodiments described herein are only exemplary and are not intended to limit the scope of subject matter. Thus, for example other clutch assemblies having different configurations may be used, different actuation mechanisms 210 may be employed, and other braking rack 156 orientations or shelf configurations may be used while remaining within scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An adjustable shelving system comprising:

a braking rack fixed on a wall;

a drive screw extending substantially parallel to the braking rack;

a drive motor operably coupled to the drive screw;

a shelf; and a clutch assembly fixed to the shelf and comprising a half nut positioned around the drive screw and a brake pawl positioned adjacent the braking rack, the clutch assembly being movable between a first position where the half nut closes to engage the drive screw and the brake pawl is disengaged, and a second position where the half nut is open and the brake pawl engages the braking rack.

2. The adjustable shelving system of claim 1, wherein the clutch assembly further comprises:

an actuation mechanism operably coupled to the half nut and the brake pawl, the actuation mechanism being configured for moving the clutch assembly between the first position and the second position.

3. The adjustable shelving system of claim 2, wherein the half nut is a screw nut split lengthwise into a first half and a second half, the first half and the second half being movable relative to each other.

4. The adjustable shelving system of claim 3, wherein the first half of the half nut and a back plate are coupled by an elongated pin, the second half of the half nut being slidably mounted on the elongated pin between the first half of the half nut and the back plate, and wherein the actuation mechanism is positioned between the back plate and the second half of the half nut for controlling a separation distance between the back plate and the second half of the half nut.

5. The adjustable shelving system of claim 2, wherein the actuation mechanism is a cam.

6. The adjustable shelving system of claim 2, wherein the actuation mechanism is a solenoid.

7. The adjustable shelving system of claim 1, wherein the drive screw has at least one unthreaded region.

8. The adjustable shelving system of claim 1, wherein a compression spring is positioned between a first half of the half nut and a second half of the half nut to urge the first half and the second half away from each other.

9. The adjustable shelving system of claim 1, wherein the braking rack is a geared rack defining a plurality of teeth and the brake pawl defines a negative geometry of one or more of the plurality of teeth.

10. The adjustable shelving system of claim 1, wherein the brake pawl is defined on a back side of a first half of the half nut.

11. The adjustable shelving system of claim 1, further comprising one or more lateral guide rods and lateral shelf supports, the lateral shelf supports being slidably mounted to the lateral guide rods and being coupled to the shelf.

12. The adjustable shelving system of claim 1, wherein the braking rack and the drive screw extend along the vertical direction.

13. The adjustable shelving system of claim 1, wherein the wall is a rear wall of a refrigerator appliance.

14. A refrigerator appliance defining a vertical direction, a lateral direction, and a transverse direction, the refrigerator appliance comprising:

a cabinet comprising a rear wall and defining a fresh food chamber;

a door being rotatably hinged to the cabinet to provide selective access to the fresh food chamber;

an adjustable shelving system positioned within the fresh food chamber, the adjustable shelving system comprising:

a braking rack fixed on the rear wall;

a drive screw extending substantially parallel to the braking rack;

a drive motor operably coupled to the drive screw;

a shelf; and a clutch assembly fixed to the shelf and comprising a half nut positioned around the drive screw and a brake pawl positioned adjacent the braking rack, the clutch assembly being movable between a first position where the half nut closes to engage the drive screw and the brake pawl is disengaged, and a second position where the half nut is open and the brake pawl engages the braking rack.

15. The refrigerator appliance of claim 14, wherein the clutch assembly further comprises:

an actuation mechanism operably coupled to the half nut and the brake pawl, the actuation mechanism being configured for moving the clutch assembly between the first position and the second position.

16. The refrigerator appliance of claim 15, wherein the half nut is a screw nut split lengthwise into a first half and a second half, the first half and the second half being movable relative to each other, and wherein the first half of the half nut and a back plate are coupled by an elongated pin, the second half of the half nut being slidably mounted on the elongated pin between the first half of the half nut and the back plate, and wherein the actuation mechanism is positioned between the back plate and the second half of the half nut for controlling a separation distance between the back plate and the second half of the half nut.

17. The refrigerator appliance of claim 16, wherein a compression spring is positioned on the elongated pin between the first half of the half nut and the second half of the half nut to urge the first half and the second half away from each other.

18. The refrigerator appliance of claim 14, wherein the braking rack is a geared rack defining a plurality of teeth and the brake pawl defines a negative geometry of one or more of the plurality of teeth.

19. The refrigerator appliance of claim 14, wherein the braking rack and the drive screw extend along the vertical direction.

* * * * *